United States Patent [19]

Kishi

[11] Patent Number: 4,699,281

[45] Date of Patent: Oct. 13, 1987

[54] TELESCOPIC BOOM MECHANISM

[75] Inventor: Mitsuhiro Kishi, Ashikaga, Japan

[73] Assignee: Kabushiki Kaisha Hikoma Seisakusho, Tochigi, Japan

[21] Appl. No.: 913,542

[22] Filed: Sep. 25, 1986

Related U.S. Application Data

[63] Continuation of Ser. No. 711,611, Mar. 11, 1985, abandoned.

[30] Foreign Application Priority Data

Mar. 15, 1984 [JP] Japan ..... 59-50715

[51] Int. Cl.[4] ..... B66C 23/04

[52] U.S. Cl. ..... 212/267; 212/269; 52/118

[58] Field of Search ..... 212/199, 200, 203, 204, 212/266–269; 52/109, 111, 115, 118, 121; 182/141; 187/18; 254/122

[56] References Cited

U.S. PATENT DOCUMENTS

| | | | |
|---|---|---|---|
| 3,738,075 | 6/1973 | Nansel | 212/268 |
| 3,841,494 | 10/1974 | Chalupsky et al. | 212/268 |
| 3,863,406 | 2/1975 | Quick | 212/268 |
| 4,373,701 | 2/1983 | Kishi | 187/18 |
| 4,375,248 | 3/1983 | Kishi | 182/141 |
| 4,466,509 | 8/1984 | Kishi | 182/141 |
| 4,518,061 | 5/1985 | Wehmeyer et al. | 187/18 |

FOREIGN PATENT DOCUMENTS

| | | | |
|---|---|---|---|
| 467878 | 4/1975 | U.S.S.R. | 212/269 |
| 962185 | 9/1982 | U.S.S.R. | 212/267 |

*Primary Examiner*—Jeffrey V. Nase
*Assistant Examiner*—Stephen P. Avila
*Attorney, Agent, or Firm*—Koda and Androlia

[57] ABSTRACT

A telescopic boom for use on an elevating apparatus includes a first boom, a second boom telescopically disposed in the first boom, a third boom telescopically disposed in the second boom, a rolling mechanism disposed between the first and third booms and rollingly movably on wall surfaces of the first and third booms, and a locking lever assembly disposed on each of ends of the second and third booms in the first boom for selectively engaging the rolling mechanism to connect the rolling mechanism to one of the second and third booms at a time.

9 Claims, 11 Drawing Figures

TELESCOPIC BOOM MECHANISM

This is a continuation of application Ser. No. 711,611, filed Mar. 11, 1985, now abandoned.

BACKGROUND OF THE INVENTION

1. Field of the invention:

The present invention relates to a telescopic boom mechanism composed of a plurality of booms of different diameters telescopically assembled together and including two inner booms slidable into and out of the open ends of the boom of the maximum diameter for varying the distance between the distal ends of the inner booms.

2. Description of the Prior Art:

There have heretofore been used elevating apparatus for elevating a lifting table or platform to lift workers and/or materials to higher places for assembly, painting, repair in various locations such as construction site, highways, and other areas required work at elevated levels. Such conventional elevating apparatus include scissors-type lifts in the form of a pantograph comprising a plurality of vertically connected X-shaped arms with two arms in each X-shaped arm unit being centrally pivotally interconnected. However, in order to raise the lifting table to a higher position, the number of X-shaped arm units has to be increased. This has led to problems in that the lift as it is collapsed has an increased height, and workers will have difficulty in getting on and off the platform and also in loading and unloading materials onto and from the platform. To avoid such drawbacks, there has been proposed an elevating apparatus having an extensible and contractable arm assembly comprising a plurality of telescopic booms. Since however the booms, typically three in number, are inserted concentrically and slidable with respect to one another, there has been required a boom storing mechanism of special design.

FIG. 1 of the accompanying drawings illustrates a conventional telescopic boom mechanism including a hollow middle boom A with a hollow spacer B inserted coaxially therein, the middle boom A and the spacer B being interconnected at ends thereof. A lower boom C is slidably inserted between the middle boom A and the spacer B, and an upper boom D is slidably inserted in the spacer C. The lower and upper booms C, D can be moved in the directions of the arrows E, F, respectively, with respect to the middle boom A. When the boom mechanism is extended or contracted, the lower boom C slides in contact with the middle boom A and the spacer B, and the upper boom D slides in contact with the spacer B. Therefore, the lower and upper booms C, D can slide smoothly with respect to the middle boom A and the spacer B. With the prior arrangement, the spacer B is necessary to permit the lower and upper booms C, D to slide in isolation from each other. The need of the spacer B however complicates the machining and assembling of the mechanism, and increases the overall weight of the mechanism. Where the boom mechanism is employed in an elevating vehicle, the added weight reduces the operation efficiency of the elevating apparatus.

SUMMARY OF THE INVENTION

In view of the above prior shortcomings of the prior art, it is an object of the present invention to provide a telescopic boom mechanism including lower and upper booms slidable in different directions with no spacer interposed therebetween, the upper boom being slidable on the inner walls of a middle boom through rolling means.

According to the present invention, there is provided a telescopic boom including a first boom, a second boom telescopically disposed in the first boom, a third boom telescopically disposed in the second boom, a rolling mechanism disposed between the first and third booms and rollingly movably on wall surfaces of the first and third booms, and a locking lever assembly disposed on each of ends of the second and third booms in the first boom for selectively engaging the rolling mechanism to connect the rolling mechanism to one of the second and third booms at a time.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
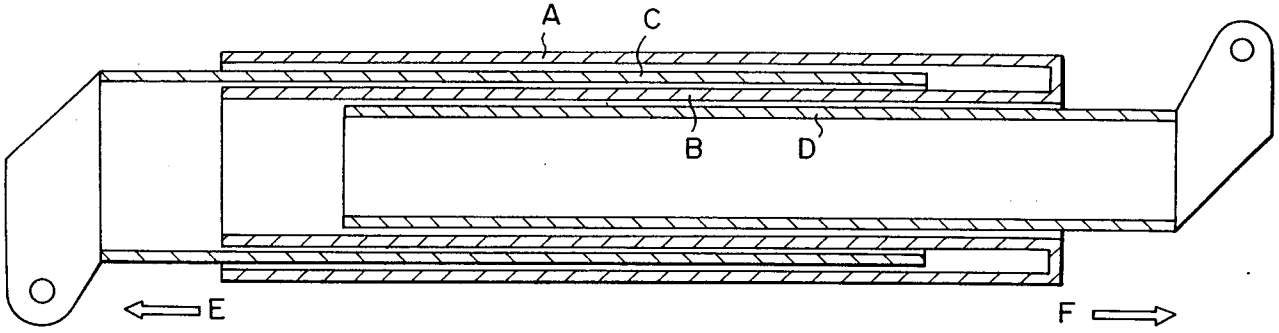
FIG. 1 PRIOR ART
FIG. 1 is a longitudinal cross-sectional view of a conventional telescopic boom mechanism.
Figure 2:
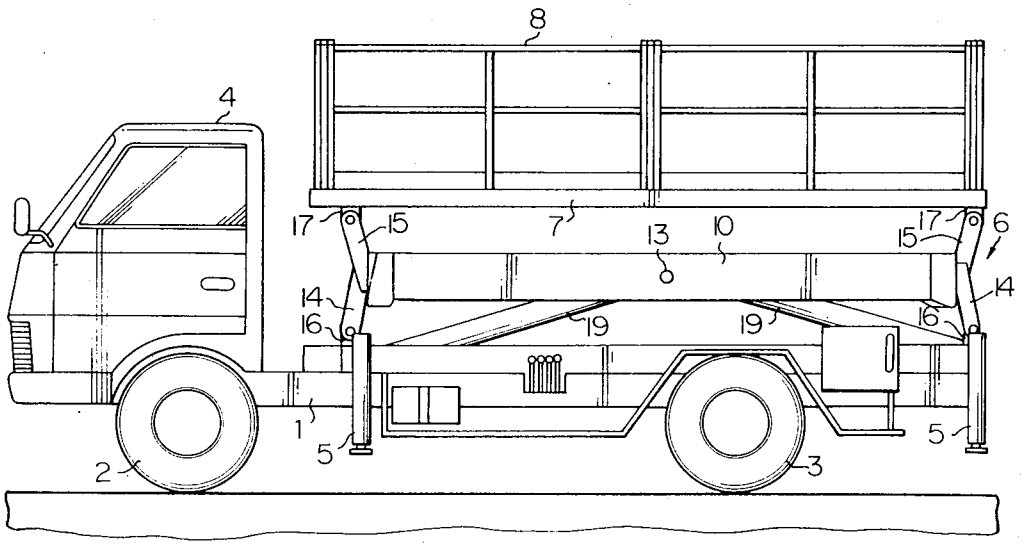
FIG. 2 is a side elevational view of an elevating vehicle in which the present invention is incorporated.
Figure 3:
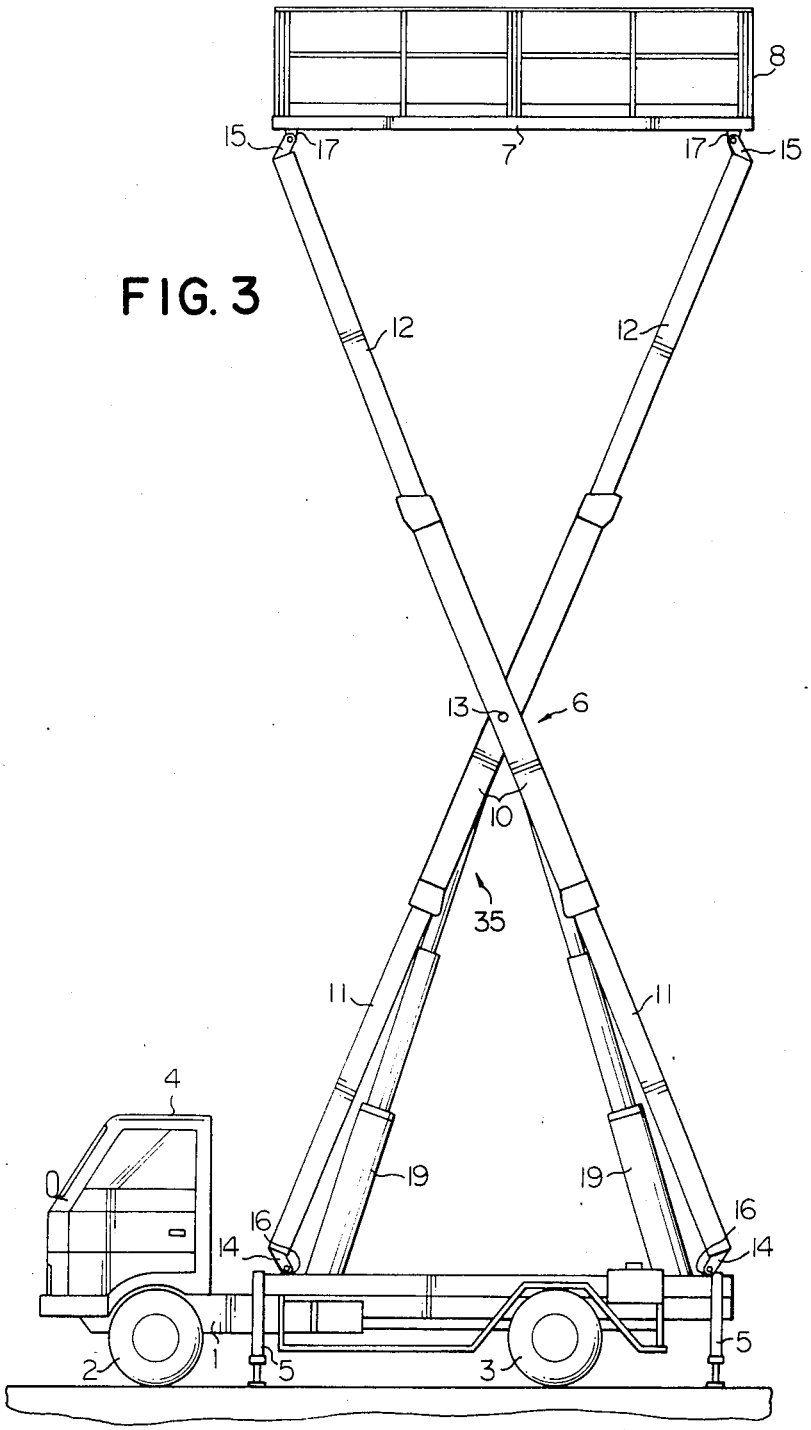
FIG. 3 is a side elevational view of the elevating vehicle with a platform elevated.
Figure 4:
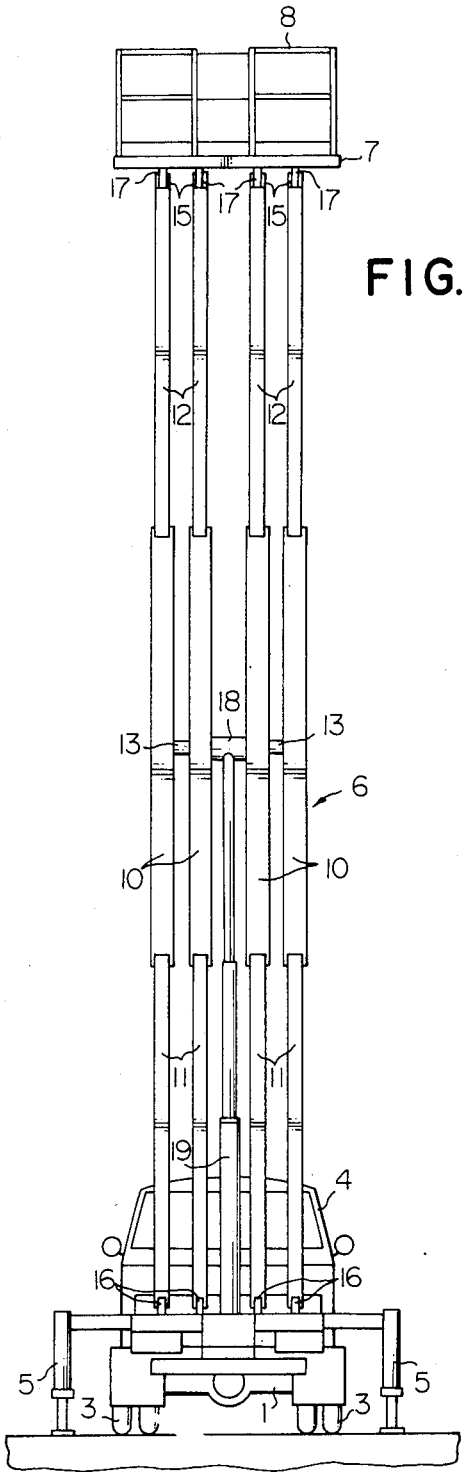
FIG. 4 is a rear elevational view of the elevating vehicle shown in FIG. 3.

The principles of the present invention are particularly useful when embodied in an elevating vehicle as shown in FIGS. 2, 3, and 4.

The elevating vehicle includes a truck having a chassis or base 1 on which front and rear wheels 2, 3 are rotatably supported, a driver's compartment 4 mounted on the chassis 1 above the front wheels 2, and pedestals or outriggers 5 attached to the chassis 1 at central and rear positions thereon. An elevating mechanism 6 is mounted on the chassis 1 and includes a platform 7 on its upper end with handrails 8 extending therearound.

As shown in FIG. 4, the elevating mechanism 6 comprises four extensible and contractable boom assemblies each composed of a middle boom 10, a lower boom 11, and an upper boom 12. The middle booms 10 are paired in two combinations, and two middle booms 10 in each pair are interconnected centrally by a shaft 13 into an X shape, the middle booms 10 being pivotally movable. The lower booms 11 are telescopically disposed in the middle booms 10 and have connectors 14 secured to lower ends thereof. Likewise, the upper booms 12 are telescopically disposed in the middle booms 10 and have connectors 15 secured to upper ends thereof. The connectors 14 are pivotally connected by pins to fixed members 16 secured to the chassis 1, and the connectors 15 are pivotally connected by pins to fixed members 17 secured to the platform 7. The fixed members 16 and the fixed members 17 are horizontally spaced equal intervals so that the platform 7 remains parallel to the chassis 1 when the elevating mechanism is extended into the X-shape as shown in FIG. 3. The two pairs of the middle booms 10 are horizontally spaced from each other, and the inner middle booms 10 in the boom pairs are interconnected centrally by a shaft 18 extending in horizontal alignment with the shafts 13. Two hydraulic cylinder mechanisms 19 are interconnected beween the chassis 1 close to the fixed members 16 and the shaft 18, the hydraulic cylinder mechanisms 19 being attached to the chassis 1 at positions thereon which are equidistant from the shaft 18.

Figure 5:
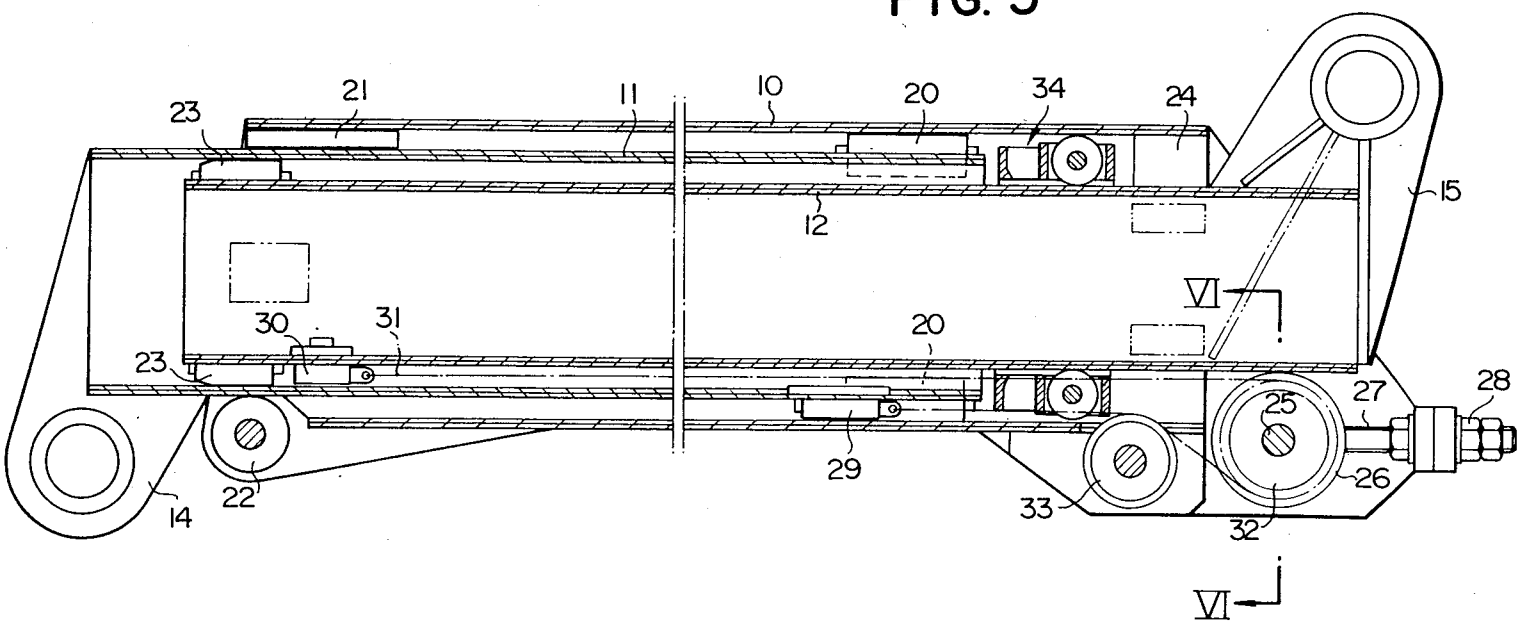
FIG. 5 is a longitudinal cross-sectional view of a telescopic boom mechanism according to the present invention.
Figure 6:
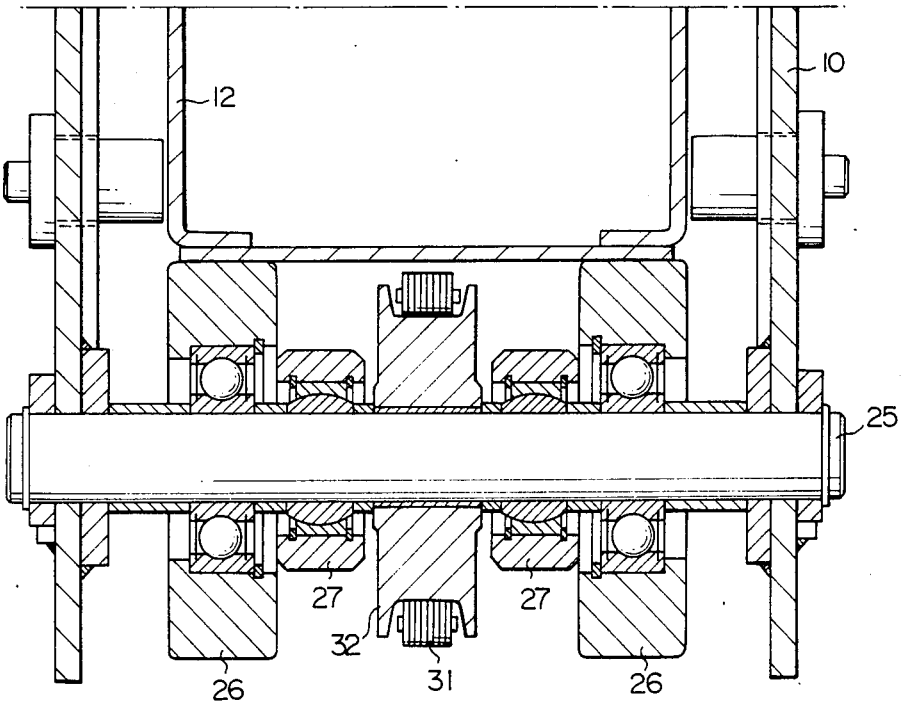
FIG. 6 is an enlarged cross-sectional view taken along line VI—VI of FIG. 5.

FIGS. 5 and 6 illustrate the internal construction of the middle booms 10. Each of the middle booms 10 is made of thin sheet steel and has a hollow structure of a rectangular cross section. The lower boom 11 is sliably inserted in the middle boom 10 through the lower end thereof. The lower boom 11 is made of thin sheet steel and has a hollow structure of a rectangular cross section. The upper boom 11 is slidably inserted in the lower boom 11 through the upper end of the middle boom 10. The upper boom 12 is made of thin sheet steel and has a hollow structure of a rectangular cross section. Sliders 20 made as of MC nylon are fixed to outer surfaces of the upper end of the lower boom 11 in sliding contact with inner surfaces of the middle boom 10. A similar slider 21 is fixed to a downward inner surface of the lower end of the middle boom 10 in sliding contact with an upward outer surface of the lower boom 11. A roller 22 is rotatably mounted on a downward portion of the lower end of the middle boom 10 in rolling contact with a downward lower surface of the lower boom 11. Sliders 23 are fixed to outer surfaces of the lower end of the upper boom 12 in sliding contact with inner surfaces of the lower boom 11. A slider 24 is fixed to a downward inner surface of the upper end of the middle boom 10 in sliding contact with an upward outer surface of the upper boom 12. A shaft 25 is mounted on a downward portion of the upper end of the middle boom 10, and rollers 26 are rotatably mounted on the shaft 25 in rolling contact with the downward outer surface of the upper boom 12. The shaft 25 is retained by hangers 27 fixed by nuts 28 to the upper end of the middle boom 10. Attachments 29, 30 are fastened respectively to the upper and lower ends of the lower and upper booms 11, 12 and are interconnected by a chain 31. A pulley 32 is rotatably mounted centrally on the shaft 25, and another pulley 33 is rotatably mounted the downwrad portion of the upper end of the middle boom 10. The chain 31 is trained around the pulley 32 and held against the pulley 33. A rolling mechanism 34 is disposed against the middle and upper booms 10, 12 and adjacent to the upper boom of the lower boom 11, the rolling mechanism 34 being movable in the middle boom 10.

Figure 7:
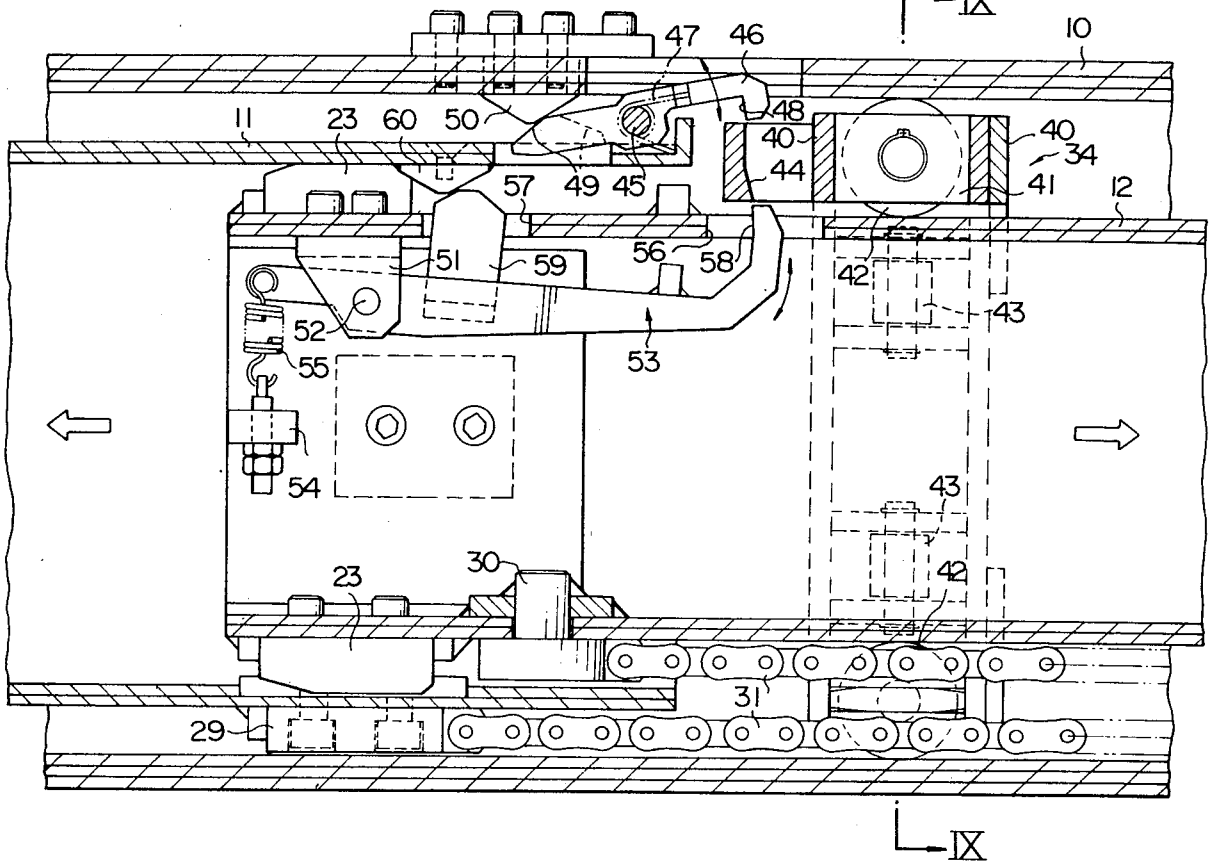
FIG. 7 is an enlarged fragmentary sectional side elevational view of a rolling mechanism in the telescopic boom mechanism of the invention.
Figure 8:
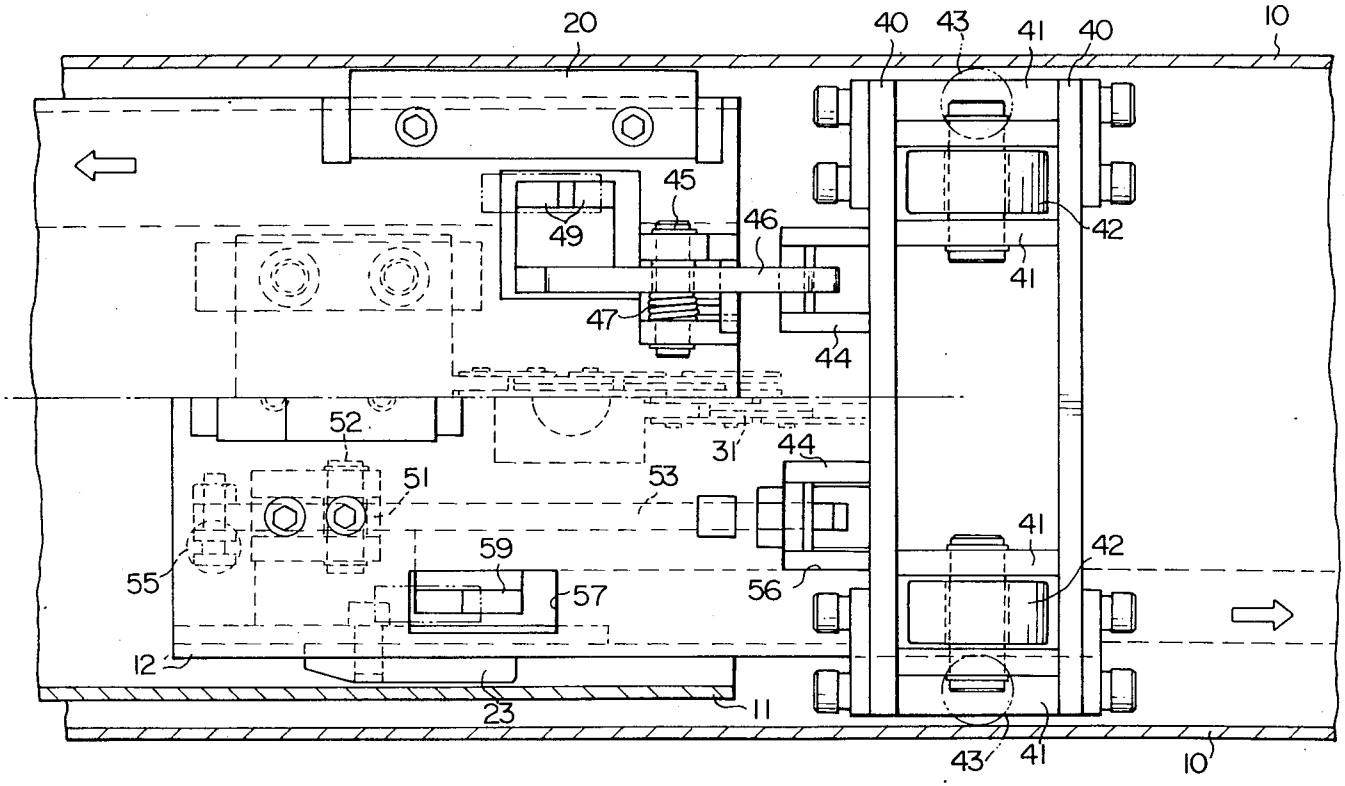
FIG. 8 is an enlarged fragmentary sectional plan view of the rolling mechanism shown in FIG. 7.
Figure 9:
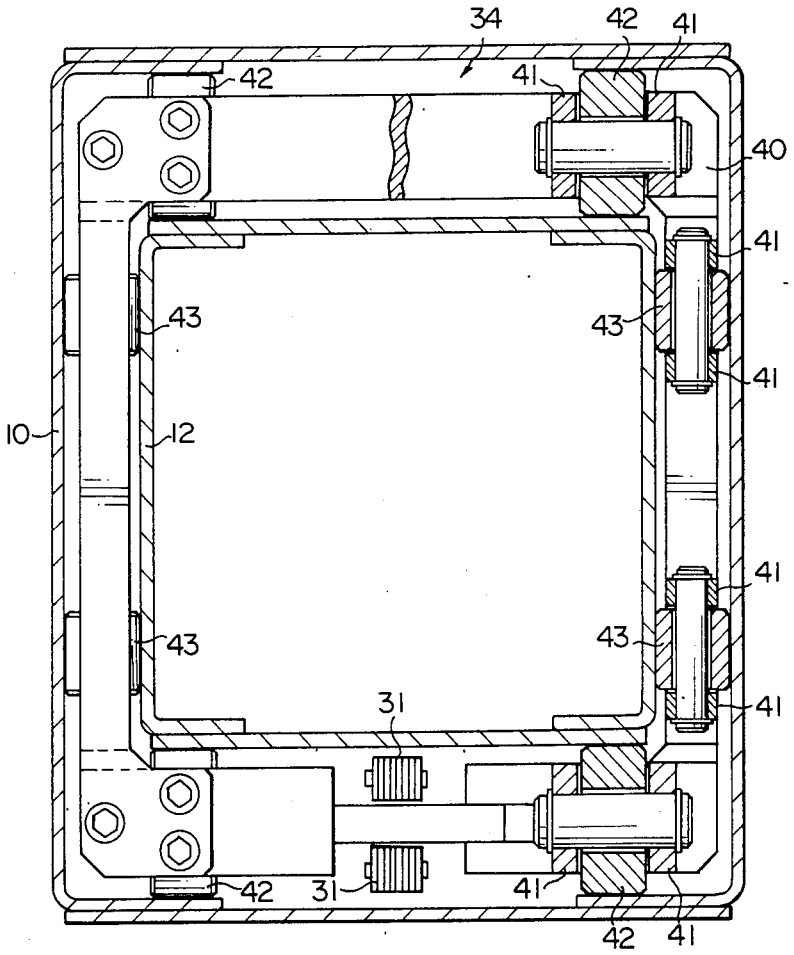
FIG. 9 is a cross-sectional view taken along line IX—IX of FIG. 7.

The rolling mechanism 34 is shown in detail in FIGS. 7, 8, and 9. The rolling mechanism 34 includes an outer frame assembly composed of a pair of holder frames 40 each of a substantially C shape and movable in the annular rectangular shape between the middle and upper booms 10, 12 out of contact with these booms 10, 12. A plurality of spacers 41 are interposed between the holder frames 40. The holder frames 40 and the spacers 41 are coupled together into a integral structure movable in the space between the booms 10, 12. Upper and lower rollers 42 and side rollers 43 are rotatably mounted on the spacers 41 between the holder frames 40. The upper and lower rollers 41 are held in rolling contact with the upper and lower surfaces of the upper boom 12, and the side rollers 43 are held in rolling contact with the side surfaces of the upper boom 12. To one of the holder frames 40 which is closer to the lower boom 11, there is fixed a pair of channel-shaped retainers 44 opening upwardly. A pin 45 is mounted on the upper surface of the upper end of the lower boom 11. A locking lever 46 is swingably mounted on the pin 45 for engagement with one of the retainers 44 and is normally urged by a spring 47 in a direction to engage the retainer 44. The locking lever 46 has an L-shaped hook 48 on an end thereof closer to the retainer 44 and a triangular cam surface 49 on the other end. Another triangular cam surface 50 is secured to the inner wall surface of the middle boom 10 at its substantially central portion for engagement with the cam surface 49. A support 51 is mounted on the inner surface of the lower end of the upper boom 12, and a locking lever 53 is swingably mounted by a pin 52 on the support 51. The locking lever 43 is normally urged in a direction to engage the other retainer 44 by a spring 55 connected between the rear end of the locking lever 43 and a spring hanger 54 fixed to the upper boom 12 therein. The upper wall of the upper boom 12 has two spaced apertures 56, 57. The locking lever 43 has on its distal end an L-shaped hook 58 projecting through the aperture 56 for engagement with the other retainer 44. The locking lever 43 also has on its intermediate portion a cam 59 having a substantially triangular, upper cam surface and projecting through the aperture 57. A triangular cam 60 is secured to the inner wall surface of the upper end of the lower boom 11 and positioned to contact the cam 59 as the lower boom 11 slides.

Operation of the telescopic boom mechanism will be described below.

An engine (not shown) on the chassis 1 is started to drive a hydraulic cylinder mechanism to supply oil under pressure to the hydraulic cylinder mechanisms 19, which extend longitudinally to pull the lower and upper booms 11, 12 out of the middle boom 10. By supplying equal amounts of oil to the hydraulic cylinder mechanisms 19, they are extended the same distance so that the shaft 13 is moved upwardly in a direction normal to the chassis 1 while the hydralic cylinder mechanisms 19 and the chassis 1 jointly form an isosceles triangle. Since the lower and upper booms 11, 12 housed in the middle boom 10 are inter connected by the chain 31, the lower and upper booms 11, 12 are extended out of the middle boom 10 by the same interval. The elevating mechanism 6 is therefore extended upwardly into an X shape. The connectors 14, 15 are spaced equal distances from the shaft 13, and the chassis 1, the elevating mechanism 6, and the platform 7 jointly form two identical isosceles triangles. Therefore, the platform 7 is lifted while kept in a horizontal position parallel to the chassis 1.

During the extension of the lower and upper booms 11, 12 while the elevating mechanism 6 is in operation, the sliders 20, 21 slide and the roller 22 rolls to allow the lower boom 11 to extend out of the middle boom 10, and the sliders 23, 24 slide and the rollers 26 roll to permit the upper boom 12 to extend out of the middle and lower booms 10, 11. At this time, the hook 48 of the locking lever 46 engages the corresponding retainer 44 and hence the rolling mechanism 34 is coupled to the lower boom 11 adjacent to the upper end thereof. The rolling mechanism 34 therefore moves with the lower boom 11 as it is moved in the middle boom 10. While the rolling mechainsm 34 is thus moved, the rollers 42, 43 rotatably mounted on the spacers 41 roll on the inner surfaces of the middle boom 10 and the outer surfaces of the upper boom 12, thus enabling the holder frames 40 to move smoothly in the middle boom 10.

Figure 10:
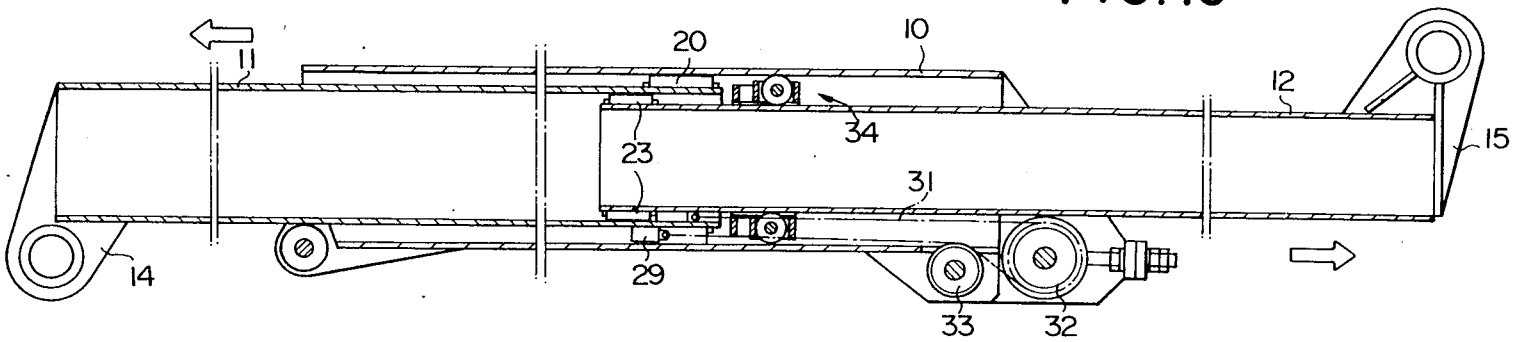
FIG. 10 is a longitudinal cross-sectional view of the telescopic boom mechanism, showing the manner in which the rolling mechanism is switched from one boom to another.
Figure 11:
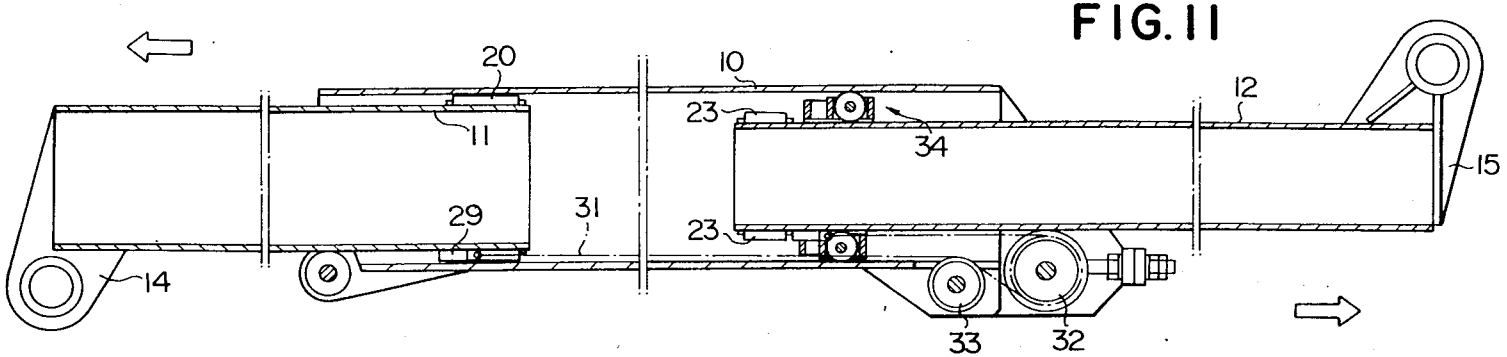
FIG. 11 is a view similar to FIG. 10, showing the rolling mechanism after it has been switched.

As the lower and upper booms 11, 12 are pulled out of the middle boom 10, the upper end of the lower boom 11 and the lower end of the upper boom 12 are positioned closely to each other as shown in FIG. 10. Upon continued movement of the upper boom 12, the spacers 23 are moved out of the lower boom 11 when they are positioned substantially centrally in the middle boom 10. At this time, the rolling mechanism 34 is disconnected from the lower boom 10 and connected to the upper boom 12 to serve as spacers between the middle and upper booms 10, 12. More specifically, as shown in FIG. 7, when the upper end of the lower boom 11 is moved to the substantially central position in the middle boom 10, the cam 50 engages the cam surface 49 to turn the locking lever 46 counterclockwise about the pin 45 for thereby moving the hook 49 out of engagement with the retainer 44. The rolling mechanism 34 is now freed from the lower boom 11. Slightly before the locking lever 46 is turned, the cam 60 engages the cam 59 to cause the locking lever 53 to turn clockwise about the pin 52 for retracting the hook 58 into the upper boom 12. With the hook 58 in the upper boom 12, the rolling mechanism 34 is moved toward the lower end of the uppe boom 12 until the space in the retainer 44 is positioned over the hook 58, whereupon the hook 48 is disengaged from the retainer 44, as described above. As the upper boom 12 is moved slightly away from the lower boom 11, the cam 59 is disengaged from the cam 60 to allow the locking lever 53 to turn counterclockwise about the pin 52 under the bias of the spring 55 thus inserting the hook 58 into the space in the retainer 44. The locking lever 58 is now held in engagement with the corresponding retainer 44. Thereafter, the cam surface 49 is disengaged from the cam 50 to turn the locking lever 56 clockwise under the force of the spring 47. Since however the rolling mechanism 34 has alrealy moved to the right (FIG. 7) with the upper boom 12, the locking lever 46 no longer engages the rolling mechanism 34. The rolling mechanism 34 is therefore coupled to the lower end of the upper boom 12 and moved therewith. FIG. 11 show the manner in which the roller mechanism 34 moves with the upper boom 12 in the middle boom 10. Even with the lower end of the upper boom 12 being pulled out of the upper end of the lower boom 11, the upper and lower sides of the lower end of the upper boom 12 are supported by the rolling mechanism 34, and hence the upper boom 12 is moved in the middle boom 10 without wobbles in the same manner as when the upper boom 12 is supported by the spacers 23 in the lower boom 11.

When the hydraulic cylinder mechanism 19 are contracted to insert the lower and upper booms 11, 12 back into the middle boom 10, the lower end of the upper boom 12 is progressively inserted into the upper end of the lower boom 11 as the lower and upper booms 11, 12 are moved from the position of FIG. 11 to that of FIG. 10. The cam surface 49 engages the cam 50 to turn the locking lever 46 counterclockwise about the pin 45 for raising the hook 48. Then, the cam 59 engages the cam 60 to turn the locking lever 58 clockwise about the pin 52 for depressing the hook 58 out of engagement with the retainer 44. The rolling mechanism 34 is now released from the upper boom 12. As the upper boom 12 is inserted further into the lower boom 11, the cam 49 is disengaged from the cam 50 to allow the locking lever 46 to turn clockwise under the resiliency of the spring 47. The hook 49 is then brought into the space in the retainer 44, whereupon the rolling mechanism 34 is coupled to the lower boom 11 and will be moved therewith. Continued movement of the upper boom 11, the cam 59 is disengaged from the cam 60 to permit the locking lever 53 to turn counterclockwise about the pin 52 under the bias of the spring 55. Since the rolling mechanism 34 has moved with the lower boom 11, the hook 58 fails to engage the retainer 44. Thus, the upper boom 12 is not coupled to the rolling mechanism 34, but slides in the lower boom 11 while being guided by the sliders 23.

With the foregoing arrangement of the present invention, there is not required any spacer boom which would otherwise be necessary to provide slide surfaces on which the upper and lower booms slide independently of each other. Therefore, the telescopic boom mechanism of the invention is reduced in overall weight. Where the telescopic boom mechanism is incorporated in an elevating apparatus, the elevating mechanism thereon can be reduced in weight and also can bear an additional load corresponding to the weight of the spacer boom that is dispensed with. As a consequence, the elevating mechanism can operate with an increased efficiency.

Although a certain preferred embodiment has been shown and described, it should be understood that many changes and modifications may be made therein without departing from the scope of the appended claims.

What is claimed is:

1. A telescopic boom mechanism consisting of:

a base;

a platform;

at least a pair of pivotally interconnected boom assemblies connecting said base and said platform together, said pair of boom assemblies including a pair of hollow middle booms extending longitudinally and pivotally interconnected substantially centrally thereof by a shaft, hollow lower booms telescopically inserted into said middle booms from lower open ends of said middle booms, hollow upper booms telescopically inserted into said middle booms from upper open ends of said middle booms and slidable on interior of said lower booms, said middle, lower and upper booms having substantially the same length, said telescopic boom assemblies contractible at the length the same as that of said middle booms when said upper and lower booms are inserted into said middle booms, said telescopic boom assemblies extendable three times as long as said middle booms when said upper and lower booms are slidably moved out of said middle booms;

synchronizing means provided in said middle booms for allowing said lower and upper booms to be moved at the same distance out of said middle booms; and a rolling mechanism interposed in a space defined between inner walls of said middle booms and outer walls of said upper booms for holding lower portions of said upper booms to keep said upper booms in parallel with said middle booms when lower ends of said upper booms are moved away from upper ends of said lower booms during sliding operation of said upper booms.

2. A telescopic boom mechanism consisting of:

a base;

a platform;

at least a pair of pivotally interconnected boom assemblies connecting said base and said platform together, said pair of boom assemblies including a pair of hollow middle booms pivotally interconnected substantially centrally thereof by a shaft, and upper and lower booms telescopically disposed in each of said middle booms and movable out of upper and lower ends of said middle booms, said lower booms having ends pivotally mounted on said base in spaced relation and said upper booms having ends pivotally mounted on said platform in spaced relation, each of said boom assemblies including means for synchronizing intervals of extension of said upper and lower booms from said middle boom, said lower booms being slidably inserted into said middle booms and said upper booms being slidably inserted into said lower booms for allowing said boom assemblies to be telescopically moved; and a rolling mechanism interposed between an inner wall of said middle boom and an outer wall of said upper booms and movable with movement of said middle booms and said upper booms for keeping said middle booms and said upper booms to be at all times in parallel with each other, said rolling mechanism comprising an annular frame composed of frames, said annular frame having a space slightly less than an annular space in cross section defined by an inner wall of said middle booms and an outer wall of said upper booms, a plurality of spacers interposed between said frames and coupled together with said frames, and a plurality of rollers supported by said frames and held in rolling engagement with the inner wall of said middle booms and the outer wall of said upper boom.

3. A telescopic boom mechanism consisting of:

a base;

a platform;

at least a pair of pivotally interconnected boom assemblies connecting said base and said platform together, said pair of boom assemblies including a pair of hollow middle booms extending longitudinally and pivotally interconnected substantially centrally thereof by a shaft, hollow lower booms telescopically inserted into said middle booms from lower open ends of said middle booms, hollow upper booms telescopically inserted into said middle booms from upper open ends of said middle booms and slidable on interior of said lower boom, said middle, lower and upper booms having substantially the same length, said telescopic boom assemblies contractible to a length substantially the same as that of said middle booms when said upper and lower booms are inserted into said middle booms, said telescopic boom assemblies extendable three times as long as said middle booms when said upper and lower booms are slidably moved out of said middle booms;

synchronizing means provided in said middle booms for allowing said lower and upper booms to be moved at the same distance of said middle booms;

a rolling mechanism interposed in a space defined between inner walls of said middle booms and outer walls of said upper booms for holding lower portions of said upper booms to keep said upper booms parallel with said middle booms when lower ends of said upper booms are moved away from upper ends of said lower booms during sliding operation of said upper booms; and a locking mechanism for selectively connecting said rolling mechanism with an upper end of said lower booms or a lower end of said upper booms when said lower booms and said upper booms are telescopically moved with respect to said middle booms.

4. A telescopic boom mechanism consisting of:

a base;

a platform;

at least a pair of pivotally interconnected boom assemblies connecting said base and said platform together, said pair of boom assemblies including a pair of hollow middle booms pivotally interconnected substantially centrally thereof by a shaft, and upper and lower booms telescopically disposed in each of said middle booms and movable out of said upper and lower ends of said middle booms, said lower booms having ends pivotally mounted on said base in spaced relation and said upper booms having ends pivotally mounted on said platform in spaced relation, each of said boom assemblies including means for synchronizing intervals of extension of said upper and lower booms from said middle boom, said lower booms being slidably inserted into said middle booms and said upper booms being slidably inserted into said lower booms for allowing said boom assemblies to be telescopically moved;

a rolling mechanism interposed between an interval of said middle boom and an outer wall of said upper booms and movable with movement of said middle booms and said upper booms for keeping said middle booms and said upper booms to be at all times in parallel with each other; and a locking mechanism for selectively connecting said rolling mechanism with an upper end of said lower booms or a lower end of said upper booms when said lower booms and said upper booms are telescopically moved with respect to said middle booms, said locking mechanism comprising a first engaging means provided on an upper end of said lower booms, a second engaging means provided on a lower end of said upper booms, and first and second selection means provided on said first and second engaging means for selectively engaging said rolling mechanism.

5. A telescopic boom mechanism according to claim 4, wherein said first and second engaging means are first and second levers.

6. A telescopic boom mechanism according to claim 4, wherein said first and second selection means are first and second hooks.

7. A telescopic boom mechanism according to claim 4, wherein said locking mechanism further includes first and second cams provided on said middle and lower booms, respectively, a first cam surface on said first engaging means for engaging said first cam to release said first selection means out of engagement with said rolling mechanism, a second cam surface on said second engaging means for engaging said second cam to release said second selection means out of engagement with said rolling mechanism.

8. A telescopic boom mechanism according to claim 7, wherein said first and second cams are positioned to engage said first and second cam surfaces at different times.

9. A telescopic boom mechanism according to claim 4, wherein said locking mechanism also includes a first spring for normally urging said first engaging means to cause said first selection means to engage said rolling mechanism, and a second spring for normally urging said second engaging means to cause said second selection means to engage said rolling mechanism.

* * * * *